United States Patent [19]

Reimers

[11] Patent Number: 5,010,218

[45] Date of Patent: Apr. 23, 1991

[54] FLOAT CONTROLLED SWITCH

[76] Inventor: Paul P. Reimers, 720 N. Wood St., Valentine, Nebr. 69201

[21] Appl. No.: 478,840

[22] Filed: Feb. 9, 1990

[51] Int. Cl.[5] ..... H01H 35/18

[52] U.S. Cl. ..... 200/84 R

[58] Field of Search ..... 200/84

[56] References Cited

U.S. PATENT DOCUMENTS 2,835,270 5/1958 York et al. ..... 200/84 R 3,028,463 4/1962 Birch ..... 200/84 R

*Primary Examiner*—J. R. Scott

*Attorney, Agent, or Firm*—Michael I. Kroll

[57] ABSTRACT

A float controlled switch is disclosed. The float controlled switch includes a switch portion, a float portion being displaced a distance from the switch portion, and a tank. The float portion is disposed in the tank filled with a liquid while the switch portion is disposed outside of the tank so that the switch portion is protected from the liquid.

8 Claims, 1 Drawing Sheet

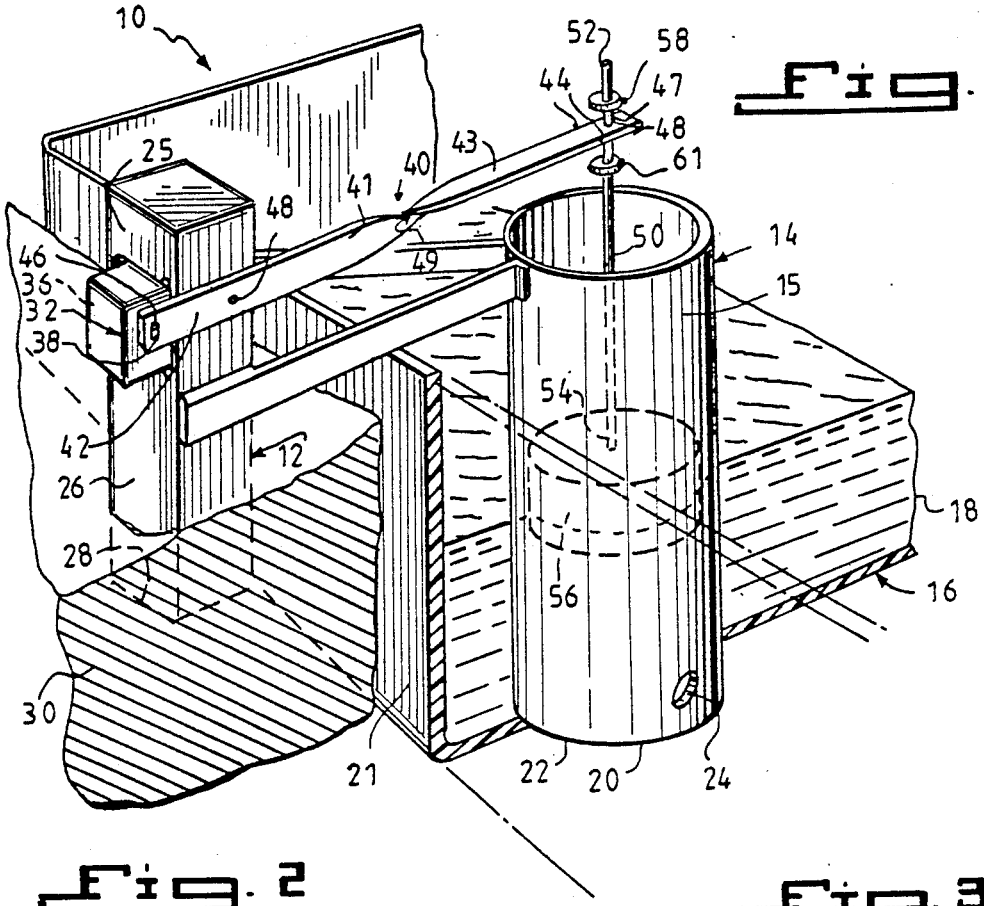
Fig. 1
Fig. 2
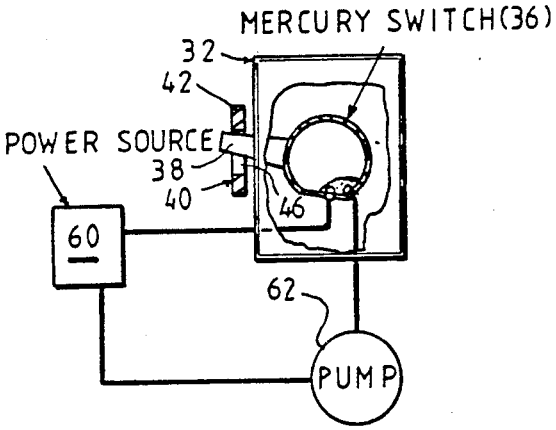
Fig. 3
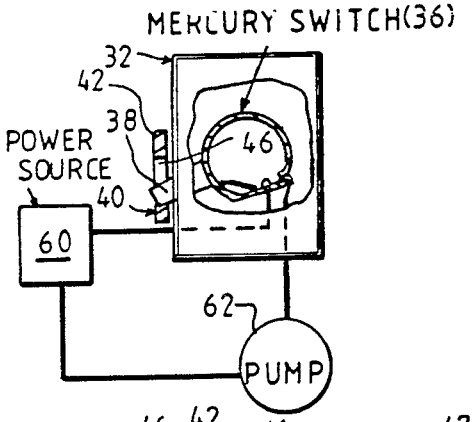
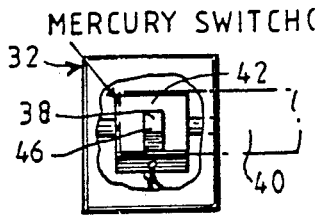
Fig. 4
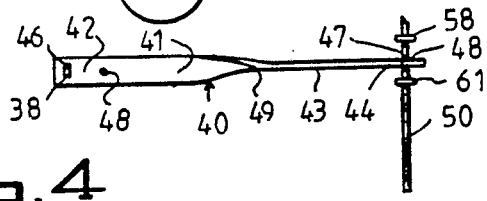
Fig. 1A

FLOAT CONTROLLED SWITCH

BACKGROUND OF THE INVENTION

1. Field of the Invention:

The present invention relates to a switch.

More particularly, the present invention relates to a float controlled switch which controls the electrical current to a pump which in turn regulates the water level in stock tanks or water systems.

2. Description of the Prior Art:

Numerous innovations for float controlled switches have been provided in the prior art that are adapted to be used. Even though these innovations may be suitable for the specific individual purposes to which they address, they would not be suitable for the purposes of the present invention as heretofore described.

SUMMARY OF THE INVENTION

Accordingly, it is an object of the present invention to provide a float controlled switch which avoids the disadvantages of the prior art.

More particularly, it is an object of the present invention to provide a switch mounted on a self contained support, molded of plastic, and disposed outside the tank so that no holes or clamps are needed to secure the switch to the tank. Furthermore, the circular cylinder allows the water level and the float to remain steady and quiet, as compared to the water outside the cylinder which may vary 2 to 3 inches or more on a windy day.

In keeping with these objects, and with others which will become apparent hereinafter, one feature of the present invention resides, briefly stated, in a float controlled switch, including a switch portion, a float portion displaced a distance from the switch portion, and a tank, wherein the float portion is disposed in the tank filled with a liquid while the switch portion is disposed outside of the tank.

When the float controlled switch is designed in accordance with the present invention, the switch portion is protected from the liquid.

In accordance with another feature of the present invention, the float portion includes a hollow circular cylinder with a closed bottom, the hollow circular cylinder contains a hole approximately near the closed bottom of the hollow circular cylinder.

Another feature of the present invention is that the switch portion includes a substantially square self contained support, the self-contained support is made form plastic and has an end that is tampered into the ground outside the tank so that no holes or clamps are necessary to secure the switching portion to the tank.

Yet another feature of the present invention is that the switch portion includes a switching box which internally contains a mercury switch which is approximately disposed on the upper portion of the support unit, the mercury switch having a protrusion.

Still another feature of the present invention is that it further comprises a lever having a first portion with a first end and a second portion with a second end, the first portion being twisted 90° to the second portion, the first end contains a slot through which the protrusion of the mercury switch pivotally passes and forms a pivot joint so that the mercury switch is pivotally and adjustably mounted to the lever, the second end containing an aperture functioning a another pivot point.

Yet still another feature of the present invention is that it further comprises a float and a rod having a first end and a second end, the first end is connected to the float, the second end of the rod includes a first collar and a second collar, the rod enters the pivot point where the rod is pivotally connected to the second portion of the lever two armed fork and exits the second portion with the second collar disposed below the second portion and the first collar disposed above the second portion of said lever.

Still yet another feature of the present invention is that the first set screw collar and the second set screw collar are slid onto the rod so that the range of motion of the lever can be controlled with regards to the liquid level.

Another feature of the present invention is that the circular cylinder is closed and contains the hole at the closed end so that the liquid and the float remain steady and quite as compared to the liquid outside the cylinder which may vary 2 to 3 inches or more on windy days.

Yet another feature of the present invention is that when the liquid is used the float slowly and steadily moves the lever as the float continues down, the mercury switch is triggered to the closed position in which the circuit is closed and the pump starts.

Still another feature of the present invention is that the pump receives power from a power source, as the pump replenishes the level of the liquid it slowly and steadily moves the float up again and finally triggers the mercury switch to an opened position in which the circuit is broken and the pump stops.

The novel features which are considered characteristic for the invention are set forth in particular in the appended claims. The invention itself, however, both as to its construction and its method of operation, together with additional objects and advantages thereof, will be best understood from the following description of the specific embodiments when read in connection with the accompanying drawing.

BRIEF DESCRIPTION OF THE DRAWING

FIG. 1 is a perspective view of the float controlled switch of the present invention, with the float in the intermediate position;

FIG. 1A is a side view of the float controlled switch of the present invention, as shown in FIG. 1;

FIG. 2 is a schematic view of the switching circuit of the float controlled switch of the present invention, with the mercury switch in the open position;

FIG. 3 is a schematic view of the switching circuit of the float controlled switch of the present invention, with the mercury in the closed position; and FIG. 4 is a front view, with parts broken away of the mercury switch of the float controlled switch of the present invention.

DETAILED DESCRIPTION OF THE PREFERRED EMBODIMENT

Referring now to FIG. 1, the float controlled switch of the present invention is shown generally at 10, and includes a switch portion 12 and a float portion 14.

The float portion 14 is located in a tank 16 containing a liquid 18. The tank 16 includes a wall 21 that separates the float portion 14 from the switch portion 12 so that the switch portion 12 is protected from the liquid 18. That is, the float portion 14 is located in the tank 16 with the liquid 18 while the switch portion 12 is located outside the tank 16.

The float portion 14 includes a hollow circular cylinder 20 with a closed or capped bottom 22. A hole 24 is located on the hollow circular cylinder 20 approximately at the closed or capped bottom 22.

The switch portion 12 is located outside the tank 16 and includes a substantially square self contained support 26. The self contained support 26 is made of plastic, but is not limited to it, and has an end 28 that is tampered into the ground 30, outside the tank 16.

With the arrangement of the present invention 10, the switching portion 12 is located outside of the tank 16 and is mounted to the support 26. The support 26 is tampered into the ground 30 so that no holes or clamps are necessary to secure the switching portion 12 to the tank 16.

The details of the switching box 32 are best seen in FIGS. 2 to 4. The switching box 32 internally contains a mercury switch 36, which is located approximately on the upper portion 25 of the support unit 26. The mercury switch 36 has a protrusion 38.

A lever 40 has a first portion 41 with a first end 42 and a second portion 43 with a second end 44. The first end 42 contains a slot 46 through which the protrusion 38 of the mercury switch 36 pivotally passes and form a pivot joint 48 so that the mercury switch 36 is pivotally and adjustably mounted to the lever 40. The second end 44 has a pivot point 48.

A rod 50 has a first end 52 and a second end 54. The second end 54 is screwed into the float 56, as shown in phantom in FIG. 1. The first end 52 of the rod 50 includes a first set screw collar 58 and a second set screw collar 61. The rod 50 passes through the aperture 47 which with the rod 50 form a pivot point 48 where the rod 50 is pivotally connected to the lever 40 and exits the lever 40 with the second collar 61 disposed below the lever 40 and the first collar 58 disposed above the lever 40. The adjustable set screw collars 58 and 61 are slid on to the rod 50 so that the range of motion of the lever 40 can be controlled regarding the liquid level.

The strap iron lever 40 is twisted 90°. The rod 50 passes through a 7/16 hole so that it will not bind. The lever 40 regulated by the two set screw collars 58 and 61 which slide up and down to any position on the rod 50.

In operation, the closed circular cylinder 15 contains the hole 24 at its closed end 22. The hole 24 allows the liquid 18 and the float 56 to remain steady and quiet, as compared to the liquid 18 outside the cylinder 20, which may vary 2 to 3 inches or more on windy days.

Furthermore, as the liquid 18 is used, the float 56 slowly and steadily moves the lever 40 which triggers a mercury switch 36. As the float 56 continues down, the mercury switch 36 is triggered to the position shown in FIG. 2, in which the circuit is closed and the pump 62 starts. Power is supplied to the pump 62 from the power source 60. As the pump 62 replenishes the level of liquid 18 it slowly and steadily moves the float 56 up again and finally triggers the mercury switch 36 to the position shown in FIG. 3, in which the circuit is broken and the pump 62 stops.

It will be understood that each of the elements described above, or two or more together, may also find a useful application in other types of constructions differing from the type described above.

While the invention has been illustrated and described as embodied in a float controlled switch, it is not intended to be limited to the details shown, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

I claim:

1. A float controlled switch, comprising:

(a) a switch portion;

(b) a float portion being displaced a distance from said switch portion;

(c) a tank, said float portion being disposed in said tank filled with a liquid while said switch portion is disposed outside of said tank so that said switch portion is protected from said liquid;

(d) said float portion includes a hollow circular cylinder with a closed bottom, said hollow circular cylinder containing a hole approximately near said closed bottom of said hollow circular cylinder; and (e) said switch portion includes a substantially square self contained support, said self contained support being made of plastic and having an end that is tampered into the ground outside the tank so that no holes or clamps are necessary to secure said switching portion to said tank.

2. A switch as defined in claim 1, wherein said switch portion includes a switching box which internally contains a mercury switch which is approximately disposed on the upper portion of said support unit, said mercury switch having a protrusion.

3. A switch as defined in claim 2; further comprising a leg having a first portion with a first end and a second portion with a second end, said first portion being twisted 90° to said second portion, said first end containing a slot through which said protrusion of said mercury switch pivotally passes and forms a pivot joint so that the mercury switch is pivotally and adjustably mounted to said lever, said second end containing an aperture functioning as another pivot point.

4. A switch as defined in claim 3; further comprising a float and a rod having a first end and a second end, said first end being connected to said float, said second end of said rod includes a first collar and a second collar, said rod enters said pivot point where said rod is pivotally connected to said second portion of said lever and exits said second portion with said second collar disposed below said second portion and said first collar disposed above said second portion of said lever.

5. A switch as defined in claim 4, wherein said first set screw collar and said set screw second collar are slid onto said rod so that the range of motion of said lever can be controlled with regards to the liquid level.

6. A switch as defined in claim 5, wherein said circular cylinder is closed and contains said hole at said closed end so that said liquid and said float remain steady and quiet as compared to said liquid outside said cylinder which may vary 2 to 3 inches or more on windy days.

7. A switch as defined in claim 6, wherein when said liquid is used said float slowly and steadily moves said lever as said float continues down, said mercury switch is triggered to the closed position in which the circuit is closed and the pump starts.

8. A switch as defined in claim 7, wherein said pump receives power from a power source, as said pump replenishes the level of said liquid it slowly and steadily moves said float up again and finally triggers said mercury switch to an open position in which said circuit is broken and said pump stops.

* * * * *